United States Patent [19]

Küpper

[11] Patent Number: 4,750,622

[45] Date of Patent: Jun. 14, 1988

[54] APPARATUS FOR SORTING SPENT TUBES

[75] Inventor: Wilhelm Küpper, Wegberg, Fed. Rep. of Germany

[73] Assignee: W. Schlafhorst & Co., Fed. Rep. of Germany

[21] Appl. No.: 934,723

[22] Filed: Nov. 25, 1986

Related U.S. Application Data

[63] Continuation-in-part of Ser. No. 725,015, Apr. 18, 1985, Pat. No. 4,681,230.

[30] Foreign Application Priority Data

Nov. 28, 1985 [DE] Fed. Rep. of Germany ..... 3542085

[51] Int. Cl.[4] ..... B07C 5/36; B65H 67/06

[52] U.S. Cl. ..... 209/615; 209/927; 242/35.5 A

[58] Field of Search ..... 209/606, 615, 651, 652, 209/653, 700, 940, 927, 657, 517; 198/398; 83/909, 923; 242/35.5 A

[56] References Cited

U.S. PATENT DOCUMENTS

| | | | |
|---|---|---|---|
| 1,136,051 | 4/1915 | Ryon | 209/927 |
| 2,355,280 | 8/1944 | Dichter | 209/653 |
| 2,459,309 | 1/1949 | Cotchett | 209/927 |
| 2,615,566 | 10/1952 | Ball et al. | 209/927 |
| 2,868,372 | 1/1959 | Ferguson | 209/927 |
| 3,031,059 | 4/1962 | Ingham | 198/398 |
| 3,305,087 | 2/1967 | Lucker | 209/927 |
| 3,618,306 | 11/1971 | Fenstermacher | 198/398 |
| 4,681,230 | 7/1987 | Kupper | 209/615 |

FOREIGN PATENT DOCUMENTS

| | | | |
|---|---|---|---|
| 2149573 | 4/1973 | Fed. Rep. of Germany | 209/927 |
| 429855 | 9/1972 | U.S.S.R. | 209/652 |

*Primary Examiner*—Robert B. Reeves
*Assistant Examiner*—Donald T. Hajec
*Attorney, Agent, or Firm*—Shefte, Pinckney & Sawyer

[57] ABSTRACT

An apparatus for sorting spent tubes as they are carried on an intermittently advancing conveyor with the apparatus having a tube ejecting device that reciprocates along the length of tubes during dwells in conveyor movement and has a tube contacting element that slides along clean surfaces of the tubes without causing ejection but engages any residual windings of yarn on tubes to thereby force the tubes with residual windings to move longitudinally and out off the conveyor. The tube contacting element has a base portion with resilient flat teeth projecting therefrom longitudinally with respect to the tubes and in the direction of tube ejecting movement. The base portion is a flat resilient plate from which the teeth project at an inclination toward the tube surface for resilient biasing thereagainst to facilitate engagement of residual windings thereon and resulting ejection of tubes with yarn windings while allowing clean tubes to remain on the conveyor.

4 Claims, 1 Drawing Sheet

FIG. 3
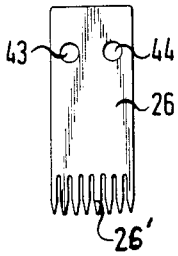
FIG. 2
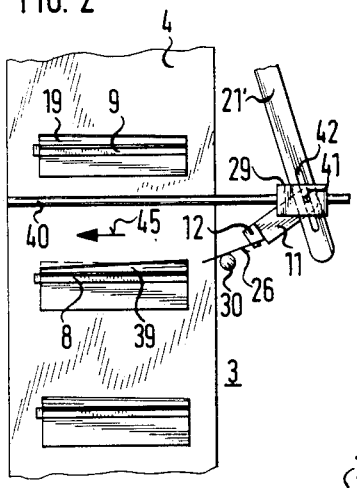
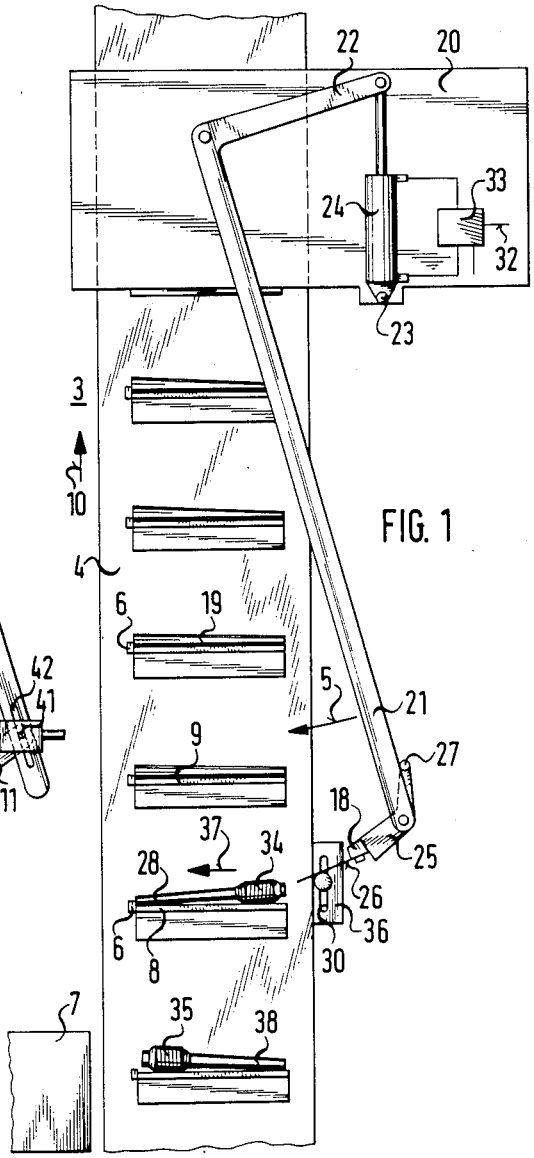
FIG. 1

APPARATUS FOR SORTING SPENT TUBES

This application is a continuation-in-part of U.S. patent application Ser. No. 725,105, filed Apr. 18, 1985 now U.S. Pat. No. 4,681,230.

BACKGROUND OF THE INVENTION

The present invention relates to an apparatus for sorting spent tubes and more particularly to an apparatus that automatically separates spent tubes with residual yarn thereon from clean tubes during recycling.

Spent tubes doffed from automatic winders are recycled for reuse at spinning frames. In such recycling it is necessary that only clean tubes be reused and that any tubes with residual yarn windings thereon be sorted out and cleaned before reuse. This involves either an expensive manual operation to assure reliability or a less reliable, but still expensive, automatic operation.

In co-pending parent U.S. patent application Ser. No. 725,015, now U.S. Pat. No. 4,681,230, there is disclosed an automatic tube sorting apparatus that is relatively inexpensive and reliable. In that apparatus the tubes are carried on an intermittently advancing conveyor and a tube ejecting device reciprocates along the length of the tubes during dwells in conveyor movement. The ejecting device has a tube contacting element that slides along clean surfaces of tubes without causing ejection so that clean tubes stay on the conveyor, but the tube contacting element engages any residual windings of yarn on tubes to thereby force tubes with residual windings to move longitudinally and out off the conveyor so that they can be cleaned completely before recycling.

The present invention is an improvement in the tube sorting apparatus of co-pending parent U.S. patent application Ser. No. 725,105, now U.S. Pat. 4,681,230 and provides enhanced sorting reliability with resulting increased efficiency in production results of the subsequent winding operation.

SUMMARY OF THE INVENTION

Briefly described, the present invention provides a tube contacting element of a tube ejecting device used to sort spent tubes carried on an intermittently advancing conveyor. The tube ejecting device reciprocates along the length of tubes during dwells in conveyor movement with the tube contacting portion sliding along the surfaces of the tubes without causing ejection of clean tubes but engaging any residual windings of yarn on tubes to thereby force the engaged yarn windings and the tubes on which they are wound to move longitudinally and out off the conveyor. The tube contacting element of the present invention includes a base portion and resilient flat teeth projecting from the base portion generally longitudinally with respect to the tubes and in the direction of tube ejecting movement.

In the preferred embodiment the base portion is a flat resilient plate from which the teeth, which are also flat, project in an inclination toward the tube surfaces for resilient biasing thereagainst to facilitate tube ejecting engagement of residual windings on tubes.

With this arrangement the teeth are capable of engaging even a single residual yarn winding and either break the yarn away from the tube to clean it or force the yarn to carry the tube with it and be ejected from the conveyor into a collection box. Resistance to movement of the tube as the teeth slide on the clean surface of a tube is provided in the preferred embodiment by a small projection on the conveyor in the path of the end of the tube, with the resistance being such that it will not prevent a tube from being ejected when the teeth engage a residual winding or windings of yarn that will not break free from the tube.

BRIEF DESCRIPTION OF THE DRAWINGS

FIG. 1 is a schematic side elevation of a first form of a tube sorting apparatus incorporating the yarn contacting element of the present invention;

FIG. 2 is a schematic side elevation of a second form of a tube sorting apparatus incorporating the yarn contacting element of the present invention; and FIG. 3 is a plan view of the yarn contacting element of the present invention in the form of a plate suitable for use in the apparatus of either the embodiment of FIG. 1 or the embodiment of FIG. 2.

DETAILED DESCRIPTION OF THE PREFERRED EMBODIMENT

Referring to the drawings, two forms of an automatic tube sorting apparatus are disclosed incorporating the yarn contacting element of the present invention. Except for the yarn contacting portion, both forms are identical to the apparatus disclosed in the aforementioned co-pending parent U.S. patent application Ser. No. 725,015, now U.S. Pat. No. 4,681,230 of which the present application is a continuation-in-part, and the substance of that application is incorporated herein by reference.

The tube sorting apparatus 3 of FIG. 1 includes an endless conveyor belt 4 that is disposed at a slight inclination from vertical and is trained over rollers (not shown), the upper one of which is driven by an electric motor through a stepping mechanism, such as a Geneva motion device so that the conveyor advances intermittently. The tube supports 8,9, mounted on and projecting from the conveyor 4 are spaced along the conveyor 4 a distance equal to the advancement of the conveyor between each dwell so that during each dwell the tube supports will be identically located. The direction of advancement of the conveyor 4 is designated by the arrow 10 in FIG. 1. Each tube support 8,9 is capable of supporting a single tube, three of which are illustrated in FIG. 1, as designated by the reference numerals 19,28 and 38.

The apparatus 3 includes a tube ejecting device that has a rocker arm 21 having a shift lever portion 22, the end of which is connected to a pneumatic piston-cylinder mechanism 24 pivotally mounted at 23 on the frame 20 and operated by a pneumatic valve 33 from an air supply line 32 for pivoting of the rocker arm about a pivot point 23 mounted on a frame 20 adjacent the conveyor 4. The rocker arm 21 carries a mounting 25 for a tube contacting element 26, which is shown in detail in FIG. 3. The mounting 25 is pivotally attached to the rocker arm 21 with movement limited by a stop 27. The arcuate direction of movement of the rocker arm 21 in the tube ejecting stroke is indicated by the arrow 5.

The tube contacting element 26 is formed of flat spring steel and has eight aligned resilient flat teeth 26' projecting from a base portion generally longitudinally with respect to the tubes on the conveyor and in the direction of tube ejecting movement, which is indicated by the arrow 37. Alternatively, the teeth could project from the mounting end 18 without an intermediate base portion.

The initial positioning of the tube contacting element 26 is controlled by a vertically adjustable support pin 30 mounted in a slot in a bracket 36, with the pivoted arrangement of the mounting 25 on the rocker arm 21 accommodating this adjustment. The outer end portion 18 of the mounting 25 is offset with respect to the direction of movement of the elevator 4 to such an extent that it will accommodate adjustment of the element for proper initial contact of the tube by the teeth 26' when a tube is properly positioned on a support with its smaller end at the right as viewed in FIG. 1. If a tube is improperly located on a support with its larger end to the right in FIG. 1, as is the case with tube 28, or if residual yarn windings 34 otherwise elevate the end of the tube facing the ejecting device the ends of the teeth 26' will contact the end of the tube, rather than the surface of the tube, and will force the tube to be ejected even if it has no residual yarn windings thereon.

If a clean tube is properly located on the support, as is the tube 19 in FIG. 1, the teeth 26' will contact the tube surface just above the right hand end and the teeth will slide along the surface of the tube with a very light spring pressure without the frictional force being sufficiently strong to cause the tube to rise over the small projecting stop 6 located at the left end of the support in the path of the tube. The shape and height of the stop 6 in relation to the shape of the ends of the tubes is such that the resistance will be sufficient to prevent ejection of a properly located clean tube but will not prevent ejection of either an improperly located tube or a tube that has residual yarn windings engaged by the teeth 26', such as the windings 35 on the next tube 38, which windings will slide over the stop 6.

The piston-cylinder mechanism 24 operates through a cycle to reciprocate the tube contacting element 26 through an ejecting stroke and a return stroke back to its initial position during each dwell of the conveyor, following which the conveyor steps one position to locate the next tube in place for a sorting operation. Thus, after tube 28 had been ejected the conveyor would advance the tube 38 into position for an ejecting operation and the teeth 26' would engage the yarn windings 35 on the tube 38 and cause ejection of the tube 38.

The tube sorting apparatus illustrated in FIG. 2 differs from the apparatus 3 of FIG. 1 in that it has a mounting 11 for the tube contacting element 26 carried in a guiding device that includes a slide 29 to which the mounting 25 is connected, with the slide 29 sliding on a horizontal rod 40 and being connected to the rocker arm 21' by a pin 41 and slot 42 connection so that as the rocker arm 21' reciprocates the slide 29 and connected tube contacting element 26 will move in a horizontal reciprocatory direction with the tube ejecting direction designated by the arrow 45.

In FIG. 2 the tube 39 is illustrated as being located improperly with the larger end facing the tube contacting element 26 so that the end will be engaged by the teeth 26' to cause ejecting of the tube. However, if the tube 39 had been located in proper position as indicated by the dot-dash line position, the teeth 26' of the tube contacting element 26 would not engage the end of the tube, but would slide along the tube surface, thereby allowing the tube to remain on the conveyor.

The ejecting device in FIG. 2 includes a mounting 11 with a projecting end 12 corresponding to the similar parts 25 and 18 of the device of FIG. 1 and also includes the same adjusting pin 30.

The tube contacting element 26 is illustrated in detail in FIG. 3, where it is seen that there are two mounting holes 43,44 that accommodate mounting of the element on studs projecting from the outer end portions 18 and 12 of the mountings 25, 11. FIG. 3 also illustrates the form and location of the teeth 26'. Preferably the element 26 and teeth 26' are flat and formed of spring steel, and for best results the material is of a maximum thickness of 0.3 millimeters, although this could be varied without departing from the present invention. However, the spring action and the flat form of the teeth 26' and tube contacting element 26 are significant in the preferred embodiment of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

I claim:

1. In an apparatus for sorting spent tubes with residual yarn windings thereon from spent tubes having clean surfaces, wherein the apparatus has an intermittently advancing conveyor carrying spent tubes, and a tube ejecting device having a tube contacting element and means for reciprocating the tube contacting element along the length of tubes during dwells in conveyor movement for sliding along the surfaces of tubes having clean surfaces without causing ejection of the tubes and for engaging residual yarn on tubes having residual winding of yarn thereon to thereby force tubes with residual winding to move longitudinally out off the conveyor, said tube contacting element comprising resilient flat teeth projecting generally longitudinally with respect to the tubes and in the direction of tube ejecting movement.

2. In an apparatus for sorting spent tubes according to claim 1 and characterized further in that said teeth project from a base portion.

3. In an apparatus for sorting spent tubes according to claim 1 and characterized further in that said teeth project from a portion at an inclination toward the tube surfaces for resilient biasing thereagainst to facilitate engagement of residual windings thereon.

4. In an apparatus for sorting spent tubes according to claim 1 and characterized further in that said teeth project from a flat resilient base portion.

* * * * *